US006928852B2

(12) United States Patent
Enderink

(10) Patent No.: US 6,928,852 B2
(45) Date of Patent: Aug. 16, 2005

(54) COMBINATION OF A PRESS BRAKE CLAMPING SYSTEM AND AT LEAST A PRESS BRAKE TOOL

(75) Inventor: Albert Enderink, Harfsen (NL)

(73) Assignee: Wila B.V., Lochem (NL)

( * ) Notice: Subject to any disclaimer, the term of this patent is extended or adjusted under 35 U.S.C. 154(b) by 65 days.

(21) Appl. No.: 10/403,987

(22) Filed: Mar. 31, 2003

(65) Prior Publication Data

US 2004/0187552 A1 Sep. 30, 2004

(51) Int. Cl.[7] ..... B21D 37/04

(52) U.S. Cl. ..... 72/481.1; 72/482.92; 72/389.4

(58) Field of Search ..... 72/481.1, 481.2, 72/481.6, 482.1, 482.2, 482.91, 482.92, 389.4

(56) References Cited

U.S. PATENT DOCUMENTS

| | | | | |
|---|---|---|---|---|
| 3,779,122 A | | 12/1973 | Sawell | |
| 4,787,237 A | | 11/1988 | Houston et al. | |
| 4,993,255 A | * | 2/1991 | Treillet | 72/389.4 |
| 5,009,098 A | | 4/1991 | van Merksteijn | |
| 5,042,352 A | | 8/1991 | Lux | |
| 5,245,854 A | | 9/1993 | Bruggink et al. | |
| 5,460,027 A | | 10/1995 | Takahashi | |
| 5,619,885 A | * | 4/1997 | Kawano et al. | 72/482.2 |
| 5,642,642 A | | 7/1997 | Kawano | |
| 5,782,308 A | | 7/1998 | Latten et al. | |
| 5,794,486 A | | 8/1998 | Sugimoto et al. | |
| 6,003,360 A | | 12/1999 | Runk et al. | |
| 6,138,492 A | * | 10/2000 | Vining et al. | 72/481.6 |
| 6,467,327 B1 | | 10/2002 | Runk et al. | |
| 6,557,390 B2 | * | 5/2003 | Runk et al. | 72/482.1 |
| 6,606,896 B2 | * | 8/2003 | Tarasconi | 72/482.2 |
| 6,644,090 B2 | * | 11/2003 | Gasparini | 72/481.1 |
| 6,732,564 B2 | * | 5/2004 | Runk et al. | 72/481.1 |

FOREIGN PATENT DOCUMENTS

| | | |
|---|---|---|
| DE | 31 36 440 A1 | 3/1983 |
| EP | 0 119 108 A6 | 9/1984 |
| EP | 0 237 800 A1 | 9/1987 |
| EP | 0 256 245 A2 | 2/1988 |
| EP | 0 494 714 A1 | 7/1992 |
| EP | 0 767 015 A1 | 4/1997 |
| FR | 2122977 A5 | 9/1972 |
| FR | 2 416 064 A4 | 8/1979 |
| FR | 2598 946 A | 11/1987 |
| JP | 57089929 A | 12/1982 |
| JP | 09100034 A | 4/1997 |
| SU | 741 999 B | 7/1980 |

* cited by examiner

*Primary Examiner*—David B. Jones
(74) *Attorney, Agent, or Firm*—The Webb Law Firm

(57) ABSTRACT

The invention relates to a combination of a press brake tool and a press brake clamping system for pressing the press brake tool in a press direction, said press brake clamping system comprising:

at least one clamp for clamping said tool in a clamping direction substantially perpendicular to the press direction;

a positioner for positioning said tool in the press direction; and at least one tool support surface;

said tool comprising:

a tool body;

a clamping part arranged on said tool body for clamping said tool in said clamping system, wherein the clamping part has an engagement part for engagement of the positioner onto the tool;

at least one support surface for abutment to said tool support surface; and a safety tang to prevent the tool of falling out;

wherein at least one of the positioner and the engagement part comprises a slanting surface for at least partially transforming the clamping force into a positioning force.

18 Claims, 4 Drawing Sheets

COMBINATION OF A PRESS BRAKE CLAMPING SYSTEM AND AT LEAST A PRESS BRAKE TOOL

FIELD OF THE INVENTION

The invention relates to a combination of a press brake clamping system and at least a press brake tool, which is commonly known as "American-style" tooling.

BACKGROUND OF THE INVENTION

A press brake has a massive table on which at least two robust C-frames are arranged. On the topside an upper beam is arranged between the C-frames. A bottom tool (the die) is arranged on the table or lower beam and a top tool (the punch) is arranged on the upper beam. The upper and lower beam are movable relatively to each other. The upper beam is generally movable by two synchronised hydraulic cylinders which move the top tool and the bottom tool towards each other and from each other. By placing a workpiece between the two tools, it is possible to bend the workpiece with such a press brake. At least the upper tools are arranged in a clamping system to clamp the tools and prevent them from shifting when the press brake is used or even to prevent falling out of the tool.

American-style tooling is generally made in a specific length necessary for forming a specific workpiece. Such tooling comprises a safety tang, which is shifted sideways in a correspondingly shaped groove in the upper beam. In order to be able to shift the tool it is necessary to have sufficient play of the tool in the groove. Before the tool can be clamped in the clamping system, which can be part of the upper beam, it has to be aligned to the upper beam and be brought into abutment. As the tools are generally very heavy, this aligning and bringing to abutment can not be done by hand. Therefor the upper beam is lowered, such that the upper tool makes contact with the lower tool. In this way the upper tool is pressed into abutment with the upper beam.

This method of arranging the upper tool into the upper beam is time consuming and the risk exists that the tools get damaged because they are not fully correctly aligned.

There is a tendency to use the American Style tooling for smaller batches of products. This causes the disadvantages of the exchanging of the American style tooling to become more prominent.

It is an object of the invention to provide a combination of a press brake clamping system and at least a press brake tool, in which these disadvantages are reduced or even not present anymore.

SUMMARY OF THE INVENTION

The present invention provides a combination of a press brake tool and a press brake clamping system for pressing the press brake tool in a press direction, said press brake clamping system comprising:

at least one clamp for clamping said tool in a clamping direction substantially perpendicular to the press direction;

a positioner for positioning said tool in the press direction, and at least one tool support surface;

said tool comprising:

a tool body;

a clamping part arranged on said tool body for clamping said tool in said clamping system, wherein the clamping part has an engagement part for engagement of the positioner onto the tool;

at least one support surface for abutment to said tool support surface; and a safety tang to prevent falling out of the tool, wherein at least one of the positioner and the engagement part comprises a slanting surface for at least partially transforming the clamping force into a positioning force.

The positioner provides the necessary force for bringing the tool in contact and abutment with the clamping system. This positioning force is deducted from the clamping force, which is necessary for clamping the tool into the clamping system. When the clamping force is exerted, this will also actuate the positioner, such that the tool is clamped in the correct alignment and position to the clamping system.

According to a preferred embodiment of the invention the engagement part comprises a recess and the positioner comprises a projection, which engages into the recess in order to position the tool in the press direction.

Preferably, the positioner comprises a protrusion having an at least partially slanted end surface and wherein the recess comprises at least a partially slanted end surface for engagement by the protrusion. So by pressing the protrusion into the recess both slanted surfaces come in contact and provide the positioning force such that the tool is positioned in the press direction and the support surface of the tool is in abutment with the tool support surface of the clamping system.

By providing the protrusion with a partially slanted end surface and for the remaining part with a flat end surface, both prior art American style tools and tools according to the invention can be used in the clamping system according to the invention. With prior art American style tools the protrusion provides the clamping force, wherein the flat remaining end surface is in contact with the tool.

In another preferred embodiment of the present invention the engagement part is formed by the safety tang and the positioner comprises a hook for engagement onto the safety tang in order to position the tool in the press direction. In this embodiment the safety tang is used to pull the tool up into the clamping system.

Preferably the positioner has a recess with a partially slanted end surface and wherein the clamp comprises at least a pin having an at least partially slanted end surface for engagement into the recess. In this embodiment the positioner grabs the safety tang as a hook and the pin urges, because of the slanted surface, the positioner upward and thus the tool upward into the clamping system.

In order to provide an even quicker exchange of tools in the combination according to the invention, the safety tang is retractable. When the clamp of the clamping system is released, the safety tang prevents the tool of falling out from the clamping system. The tool can then be grabbed and by retracting the safety tang the tool can be extracted from the clamping system in a vertical direction. This is quicker than the usual extraction in a sideways direction.

Preferably, the safety tang is operable by a push button extending out of the tool body. In this way the tool can be grabbed by two hands and than the push button can be operated by a thumb of the hand.

The invention further relates to a press brake clamping system for clamping a press brake tool comprising:

at least one clamp for clamping said tool in a clamping direction substantially perpendicular to a press direction;

a positioner for positioning said tool in the press direction, wherein said positioner is arranged for transforming the clamping force into a positioning force; and at least one tool support surface.

The invention also relates to a press brake tool for clamping in a clamping system having a tool support surface and a positioner for positioning the tool against the support surface, the tool comprising:

a tool body;

a clamping part arranged on said tool body for clamping said tool in said clamping system, wherein the clamping part has an engagement part for engagement of the positioner onto the tool;

at least one support surface for abutment to said tool support surface; and a safety tang to prevent the tool of falling out of the clamping system.

DETAILED DESCRIPTION OF THE PREFERRED EMBODIMENT

Figure 1:
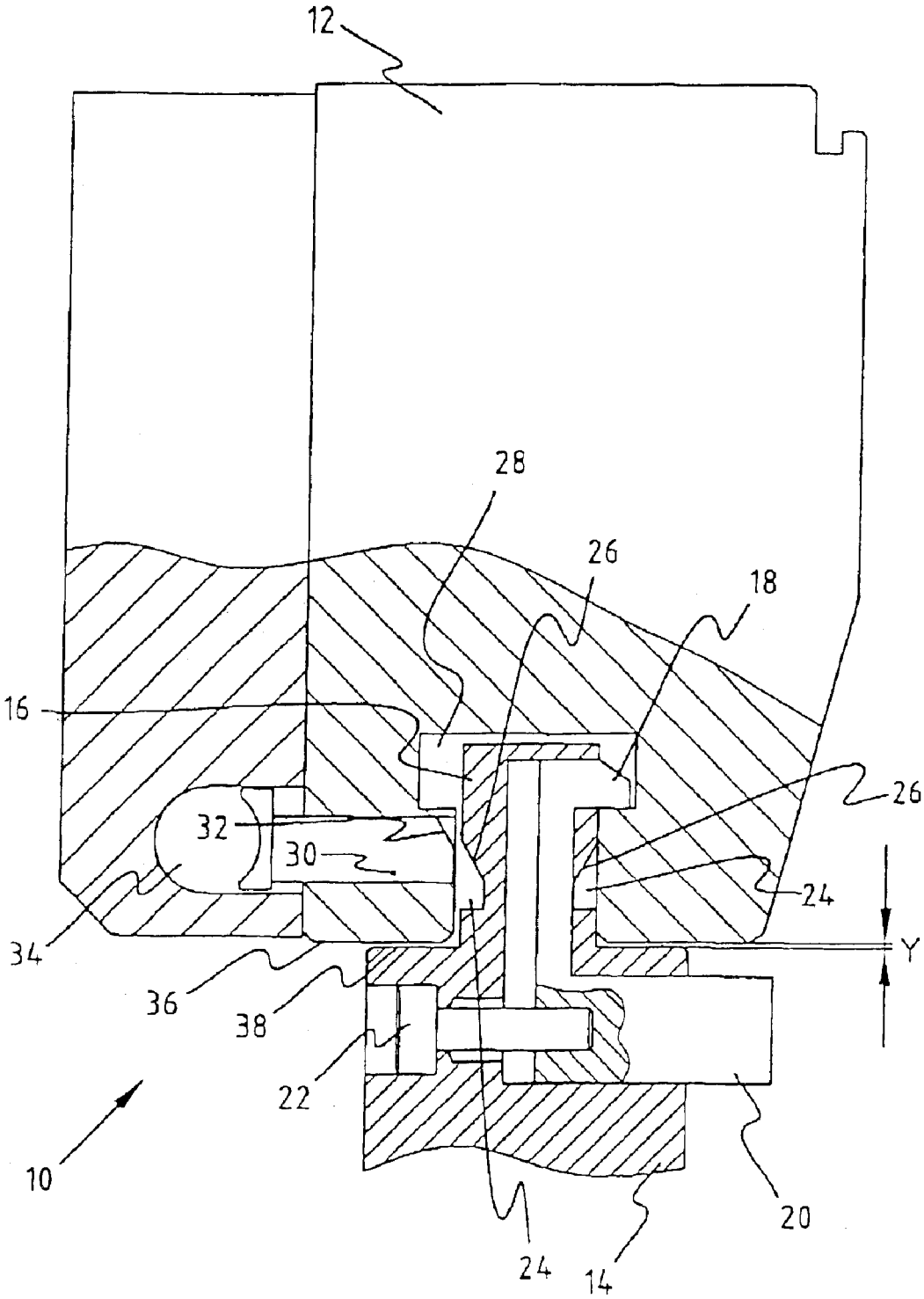
FIG. 1 is a schematic side view, partially broken away, of a preferred embodiment of the combination according to the invention.

FIG. 1 shows a first preferred embodiment 10 according to the invention. This combination 10 comprises a clamping system 12 and a tool 14. The tool 14 is generally shaped as an American style tool. It has a clamping part 16 and a safety tang 18. This safety tang 18 is retractable and operable by a push button 20, which extends from the tool body. The end position of the push button 20 is defined by a bolt 22, which is arranged into the back of the push button 20.

The clamping part 16 comprises two recesses 24, each with a slanting end surface 26.

The clamping system 12 comprises a groove 28 with a T-shaped cross section. Furthermore a horizontal pin 30 is movable and extends into the groove 28. The pin 30 has an end surface 32 which is partially slanted. The pin 30 is movable by a bellow 34, which is operable by for example pressurized air.

When the tool 14 is slid into the clamping system 12, the safety tang 18 prevents the tool 14 from falling out. However, there will exist a space Y between the tool support surface 36 and the support surface 38 of the tool.

Figure 2:
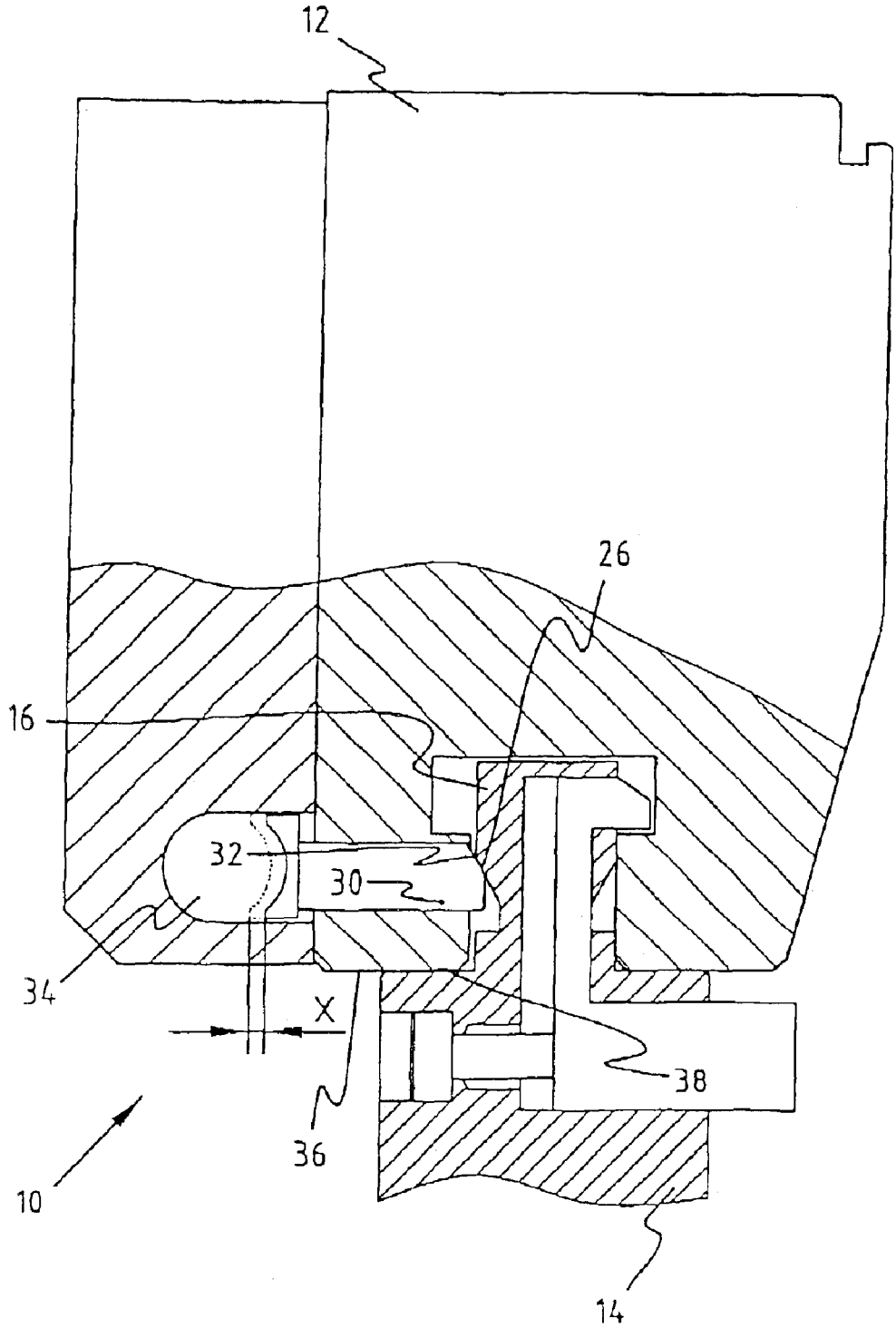
FIG. 2 shows a schematic side view according to FIG. 1 in a second position.

FIG. 2 shows the embodiment 10 according to FIG. 1 in a second position. In this position the bellows 34 has been pressurized with for example pressurized air, which causes the pin 30 to shift over a distance X. This causes the two slanting surfaces 32,26 of the pin respectively the clamping part of the tool 14 to get in contact and to lift the tool 14 upwards into the clamping system 12. This results in an abutment of the tool support surface 36 and the support surface 38 of the tool. The positioner pin 30 also provides the clamping force, such that the tool 14 lies with its clamping part 16 against the clamping system 12, such that the tool 14 is fully positioned and aligned with respect to the clamping system.

The positioner is in this example embodied by the positioner pin 30 with the slanting surface 32 and the slanting surface 26. It is also possible to embody the pin 30 with a perpendicular flat end surface. Such a flat end surface will coact with the slanting surface 26 and provide the necessary movement of a tool in press direction.

Figure 3:
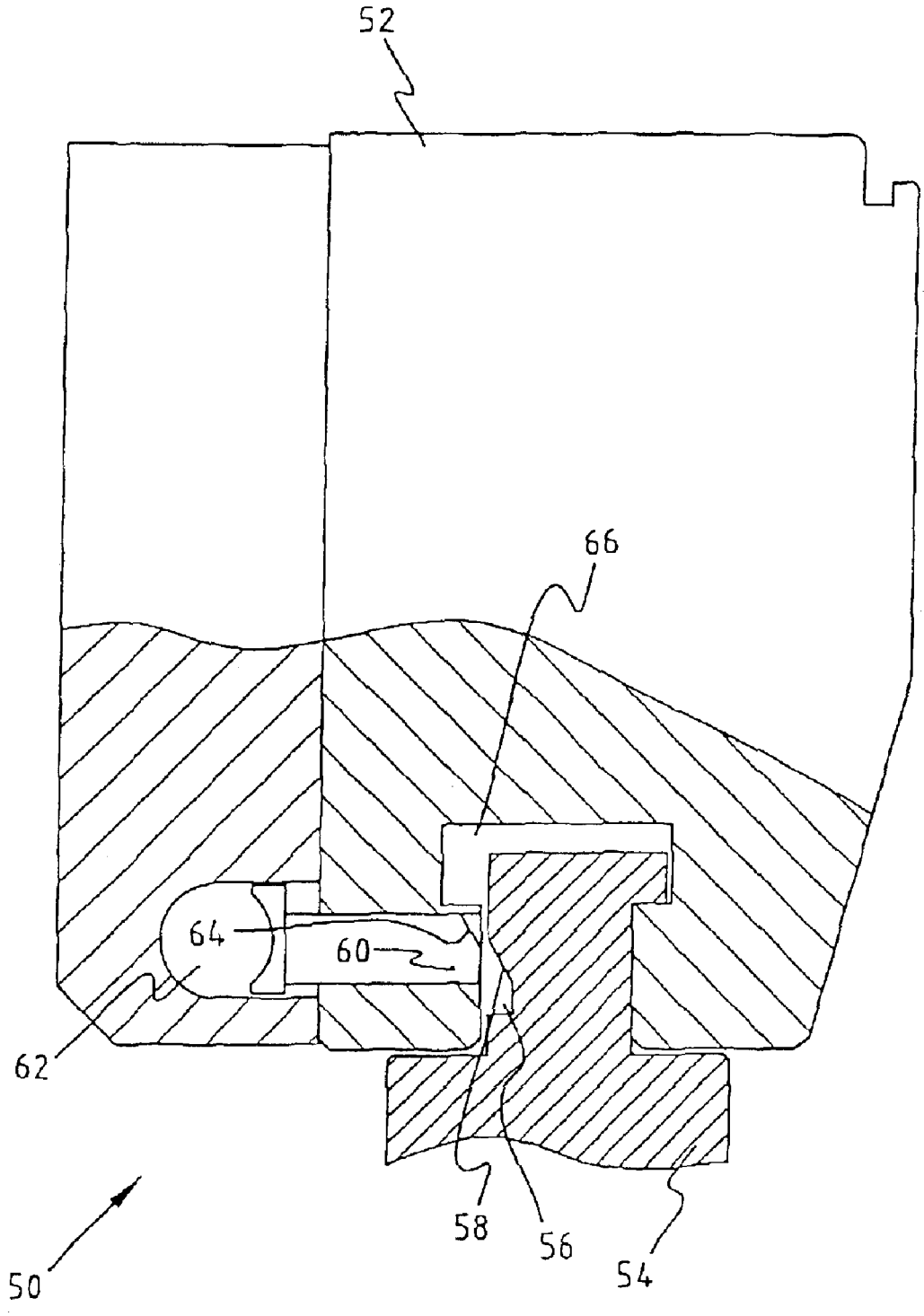
FIG. 3 is a schematic side view, partially broken away of a second embodiment of the combination according to the invention.

FIG. 3 shows a second embodiment 50 according to the invention. This embodiment 50 has a clamping system 52 and a tool 54. This tool 54 is almost identical to the prior art American style tooling except for a recess 56, which has a partially slanted end surface 58.

The clamping system 52 has a positioner pin 60, which is operable by a bellows 62. The positioner pin 60 has also a partially slanted end surface 64. The remaining part of this end surface is flat. Operation of this combination 50 is similar to the operation of the combination 10 according to FIGS. 1 and 2. Difference is that the tool 54 has to be slid sideways into the groove 66 of the clamping system 52.

In this clamping system 50, and also the clamping system 10 according to FIGS. 1 and 2, a prior art American style tool can be mounted. The clamping force is exerted by the positioner pin 60. Due to the partially flat end surface 64 it is able to provide the necessary clamping force.

In one embodiment of the present invention, the slanting end surface 26 (FIGS. 1 and 2) and the slanting end surface 64 (FIG. 3) are positioned closer to the tool body 14, 54 than the safety tang 18. The positioner, such as in the form of the pin 30 (FIGS. 1 and 2) and the positioner pin 60 (FIG. 3), extends into the groove 28 at a position that is closer to the tool body 14, 54 than the safety tang 18. The engagement part, such as in the form of the slanting surfaces 26, 64, is located closer to the tool body 14 than the safety tang 18, as well as the top portion of the groove 28. It is this relative positioning with respect to the tool body 14 that provides a more compact structure to the combination 10 of a clamping system 12 and a tool 14.

Figure 4:
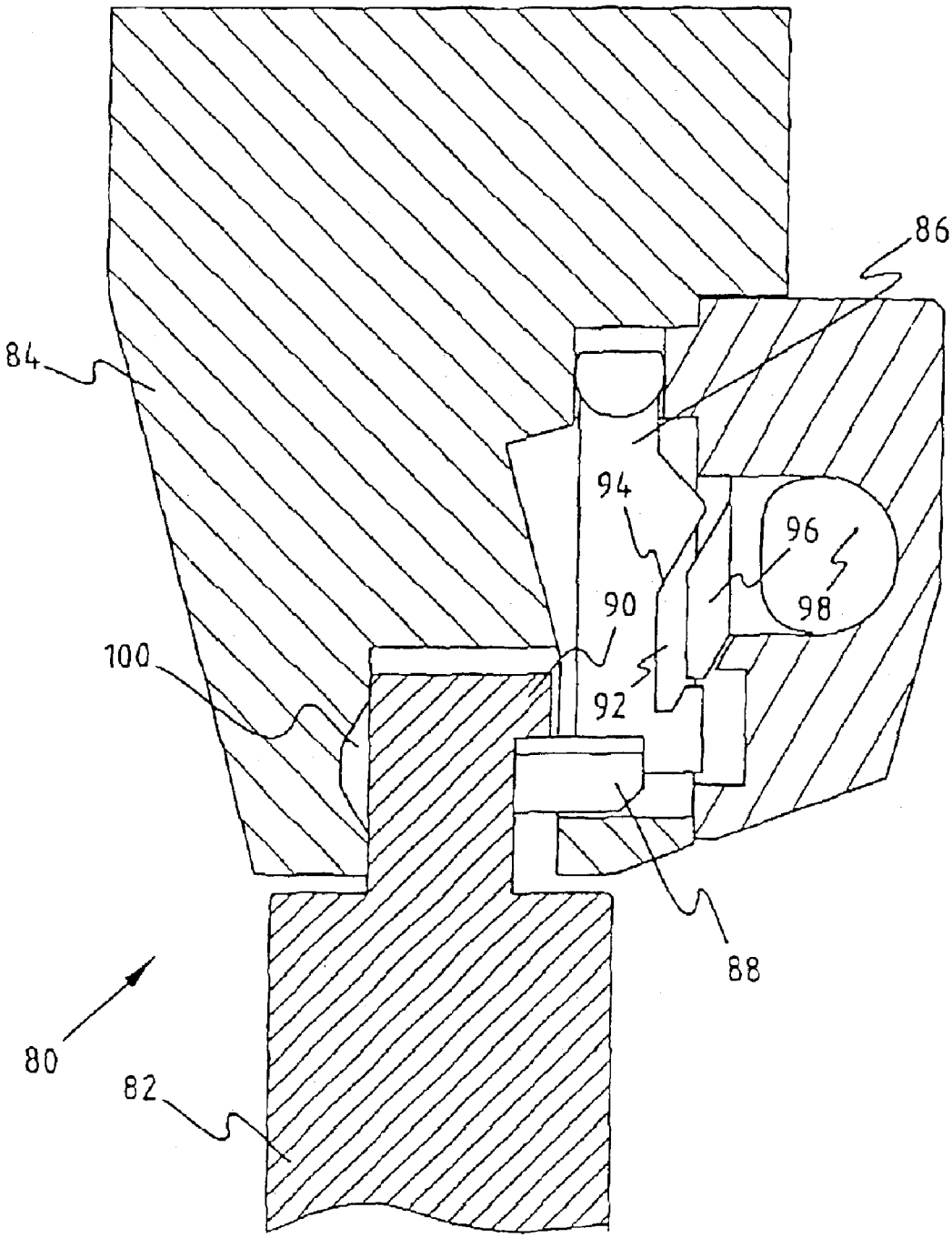
FIG. 4 is a schematic side view of a third embodiment of the combination according to the invention.

FIG. 4 shows a third embodiment 80 according to the invention. This combination 80 has a common American style tool 82 and a clamping system 84. On the clamping system 84 a positioner 86 is arranged, which has a hook 88, which engages onto the safety tang 90 of the tool 82.

The positioner 86 has furthermore a recess 92 with a partially slanted surface 94.

The clamping system 84 has also a pin 96, which is actuated by a bellows 98. The pin 96 comes in contact with the slanted surface 94 of the positioner 86, which results in the vertical movement of the positioner 86. This results in the lifting of the tool 82 into the clamping system 84. Due to the action of the bellows 98 the positioner 86 also exerted a horizontal force for clamping the tool 82 in the clamping system.

In a non energized state, as shown in FIG. 4, the tool 82 can be removed from the clamping system 84 by a turning movement. This urges the positioner 86 away such that the safety tang 90 is unhooked from the hook 88. In order to facilitate this unlocking a recess 100 is arranged in the clamping system 84.

What is claimed is:

1. A combination of a press brake tool and a press brake clamping system for pressing the press brake tool in a press direction, said press brake clamping system comprising:

a groove;

at least one clamp for clamping said tool in a clamping direction substantially perpendicular to the press direction;

a positioner configured to at least partially extend into the groove for positioning said tool in the press direction; and at least one tool support surface;

said tool comprising:

a tool body;

a clamping part arranged on said tool body for clamping said tool in said clamping system, wherein the clamping part has an engagement part for engagement of the positioner onto the tool;

at least one support surface for abutment to said tool support surface; and a safety tang extendable into and retractable from the groove to prevent the tool from falling out; wherein at least one of the positioner and the engagement part comprises a slanting surface for at least partially transforming the clamping force into a positioning forces; wherein the slanting surface is positioned closer to the tool body than the safety tang.

2. The combination according to claim 1, wherein the engagement part comprises a recess and wherein the positioner comprises a projection, which engages into the recess in order to position the tool in the press direction.

3. The combination according to claim 2, wherein the positioner comprises a protrusion having an at least partially slanted end surface and wherein the recess comprises at least a partially slanted end surface for engagement by the protrusion.

4. The combination according to claim 1, wherein the engagement part is formed by the safety tang and wherein the positioner comprises a hook for engagement onto the safety tang in order to position the tool in the press direction.

5. The combination according to claim 4, wherein the positioner has a recess with a partially slanted end surface and wherein the clamp comprises at least a protrusion having an at least partially slanted end surface for engagement into the recess.

6. The combination according to claim 1 wherein the safety tang is operable by a push button extending out of the tool body.

7. The combination according to claim 1, wherein the groove has a T-shaped cross section.

8. A press brake clamping system for clamping a press brake tool comprising:

at least one clamp for clamping said tool in a clamping direction substantially perpendicular to a press direction;

a groove;

a safety tang extendable into and retractable from the groove to prevent the tool from falling out;

a positioner configured to as least partially extend into the groove for positioning said tool in the press direction, wherein said positioner is arranged for transforming the clamping force into a positioning force; and a tool body having at least one tool support surface; wherein the position at which the positioner extends into the groove is located closer to the tool body than the safety tang.

9. The press brake clamping system according to claim 8, wherein the positioner has a slanting surface for at least partially transforming the clamping force into a positioning force.

10. The press brake clamping system according to claim 8, wherein the positioner comprises a protrusion having an at least partially slanted end surface.

11. The press brake clamping system according to claim 8, wherein the positioner comprises a hook for engagement into the safety tang in order to position the tool in the press direction.

12. The press brake clamping system according to claim 11, wherein the hook is pivotable and the at least one clamp comprises a recess, such that a tool can be removed from the clamping system by a turning movement urging the hook out of engagement.

13. The press brake clamping system according to claim 11, wherein the positioner has a recess with a partially slanted end surface and wherein the clamp comprises at least a protrusion having an at least partially slanted end surface for engagement into the recess.

14. The press brake clamping system according to claim 8, wherein the groove has a T-shaped cross section.

15. A press brake tool for clamping in a clamping system having a tool support surface and a positioner for positioning the tool against the support surface, the tool comprising:

a tool body;

a clamping part arranged on said tool body for clamping said tool in said clamping system, wherein the clamping part has an engagement part for engagement of the positioner onto the tool;

at least one support surface for abutment to said tool support surface; and a safety tang extendable into and retractable from a groove, the safety tang configured to prevent the tool from falling out of the clamping system; wherein the positioner is configured to at least partially extend into the groove; and wherein the engagement part is positioned closer to the tool body than the safety tang.

16. The press brake tool according to claim 15, wherein tool comprises a recess having at least a partially slanted end surface for engagement by the positioner.

17. The press brake tool according to claim 15, wherein the safety tang is operable by a push button extending out of the tool body.

18. The press brake tool according to claim 15, wherein the groove has a T-shaped cross section.

* * * * *

UNITED STATES PATENT AND TRADEMARK OFFICE

CERTIFICATE OF CORRECTION

PATENT NO. : 6,928,852 B2
DATED : August 16, 2005
INVENTOR(S) : Albert Enderink

It is certified that error appears in the above-identified patent and that said Letters Patent is hereby corrected as shown below:

Column 5,
Line 7, "a positioning forces" should read -- a positioning force --.
Line 41, "to as least partially" should read -- to at least partially --.

Column 6,
Lines 39-40, "wherein tool" should read -- wherein the tool --.

Signed and Sealed this

Eighth Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,928,852 C1
APPLICATION NO. : 95/000241
DATED : August 16, 2005
INVENTOR(S) : Enderink It is certified that error appears in the above-identified patent and that said Letters Patent is hereby corrected as shown below:

Column 1, Claim 1, lines 50- 51, "a positioning forces;" should read
-- a positioning force --

Column 2, Claim 8, line 1, "A press brake clamping brake clamping system" should read
-- A press brake clamping system --

Column 2, Claim 8, line 13, "at least extend" should read
-- at least partially extend --

Column 2, Claim 15, line 41, "the position" should read
-- the positioner --

Signed and Sealed this
Seventeenth Day of May, 2011

David J. Kappos

David J. Kappos
*Director of the United States Patent and Trademark Office*

US006928852C1

(12) INTER PARTES REEXAMINATION CERTIFICATE (0070th)

United States Patent

Enderink

(10) Number: US 6,928,852 C1

(45) Certificate Issued: May 26, 2009

(54) COMBINATION OF A PRESS BRAKE CLAMPING SYSTEM AND AT LEAST A PRESS BRAKE TOOL

(75) Inventor: Albert Enderink, Harfsen (NL)

(73) Assignee: Wila B.V., Lochem (NL)

Reexamination Request:
No. 95/000,241, Mar. 20, 2007

Reexamination Certificate for:

| | |
|---|---|
| Patent No.: | **6,928,852** |
| Issued: | **Aug. 16, 2005** |
| Appl. No.: | **10/403,987** |
| Filed: | **Mar. 31, 2003** |

Certificate of Correction issued Nov. 8, 2005.

(51) Int. Cl.
*B21D 37/04* (2006.01)

(52) U.S. Cl. ..... 72/481.1; 72/389.4; 72/482.92

(58) Field of Classification Search ..... 72/481.1, 72/482.92, 389.4
See application file for complete search history.

(56) References Cited

U.S. PATENT DOCUMENTS

| | | | |
|---|---|---|---|
| 5,245,854 | A | 9/1993 | Bruggink et al. |
| 6,467,327 | B1 | 10/2002 | Runk et al. |

FOREIGN PATENT DOCUMENTS

| | | |
|---|---|---|
| DE | 4115224 A1 | 12/1992 |
| FR | 2122977 | 8/1992 |

*Primary Examiner*—Matthew C. Graham

(57) ABSTRACT

The invention relates to a combination of a press brake tool and a press brake clamping system for pressing the press brake tool in a press direction, said press brake clamping system comprising:

at least one clamp for clamping said tool in a clamping direction substantially perpendicular to the press direction;

a positioner for positioning said tool in the press direction; and at least one tool support surface;

said tool comprising:

a tool body;

a clamping part arranged on said tool body for clamping said tool in said clamping system, wherein the clamping part has no engagement part for engagement of the positioner onto the tool;

at least one support surface for abutment to said tool support surface; and a safety tang to prevent the tool of falling out;

wherein at least one of the positioner and the engagement part comprises a slanting surface for at least partially transforming the clamping force into a positioning force.

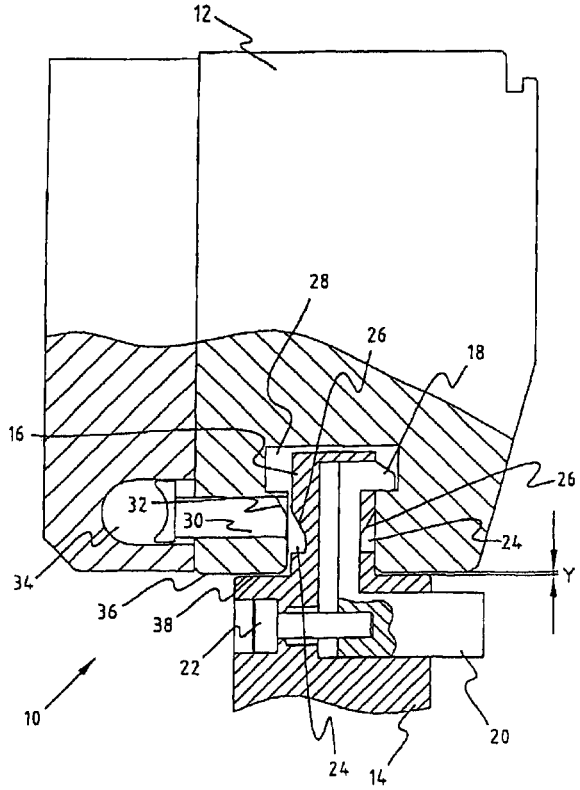

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 8 and 15–18 are determined to be patentable as amended.

Claims 3, 6, 7, 9, 10 and 14, dependent on an amended claim, are determined to patentable.

Claims 4, 5 and 11–13 were not reexamined.

1. A combination of [a] *an American-style* press brake tool and a press brake clamping system for pressing the *American-style* press brake tool in a press direction, said press brake clamping system comprising:

a groove;

at least one clamp for clamping said *American-style* tool in a clamping direction substantially perpendicular to the press direction;

a positioner configured to at least partially extend into the groove for positioning said *American-style* tool in the press direction; and at least one tool support surface;

said *American-style* tool comprising:

a tool body *configured for vertical insertion into said press brake clamping system*;

a clamping part arranged on said tool body for clamping said *American-style* tool in said clamping system, wherein the clamping part has an engagement part for engagement of the positioner onto the *American-style* tool;

at least one support surface for abutment to said tool support surface; and a safety tang extendable into and retractable from the groove to prevent the *American-style* tool from falling out; wherein at least one of the positioner and the engagement part comprises a slanting surface for at least partially transforming the clamping force into a positioning forces; wherein the slanting surface is positioned closer to the tool body than the safety tang.

2. The combination according to claim 1, wherein the engagement part comprises a recess and wherein the positioner comprises a projection, which engages into the recess in order to position the *American-style* tool in the press direction.

8. A press brake clamping brake clamping system for clamping [a] *an American-style* press brake tool comprising:

at least one clamp for clamping said *American-style* tool in a clamping direction substantially perpendicular to a press direction;

a groove;

a safety tang extendable into and retractable from the groove to prevent the *American-style* tool from falling out;

a positioner configured to at least extend into the groove for positioning said *American-style* tool in the press direction, wherein said positioner is arranged for transforming the clamping force into a positioning force; and a tool body *configured for vertical insertion into said clamping system and* having at least one tool support surface; wherein the position at which the positioner extends into the groove is located closer to the tool body than the safety tang.

15. [A] *An American-style* press brake tool for clamping in a clamping system having a tool support surface and a positioner for positioning the *American-style* tool against the support surface, the *American-style* tool comprising:

a tool body *configured for vertical insertion into the clamping system*;

a clamping part arranged on said tool body for clamping said *American-style* tool in said clamping system, wherein the clamping part has an engagement part for engagement of the positioner onto the *American-style* tool;

at least one support surface for abutment to said tool support surface; and a safety tang extendable into and retractable from a groove, the safety tang configured to prevent the *American-style* tool from falling out of the clamping system; wherein the position is configured to at least partially extend into the groove; and wherein the engagement part is positioned closer to the tool body than the safety tang.

16. The *American-style* press brake tool according to claim 15, wherein the *American-style* tool comprises a recess having at least a partially slanted end surface for engagement by the positioner.

17. The *American-style* press brake tool according to claim 15, wherein the safety tang is operable by a push button extending out of the tool body.

18. The *American-style* press brake tool according to claim 15, wherein the groove has a T-shaped cross section.

* * * * *